United States Patent [19]

Izumi

[11] Patent Number: 4,643,411

[45] Date of Patent: Feb. 17, 1987

[54] VISE FOR CLAMPING TWO WORKS

[76] Inventor: Mitsuo Izumi, 2-18, Nakano-Honmachi, Shijonawate-shi Osaka, Japan

[21] Appl. No.: 765,496

[22] Filed: Aug. 14, 1985

[51] Int. Cl.[4] ..... B25B 1/00

[52] U.S. Cl. ..... 269/153; 269/99; 269/138

[58] Field of Search ..... 269/56, 57, 99, 100, 269/138, 152, 153

[56] References Cited

U.S. PATENT DOCUMENTS

| | | | |
|---|---|---|---|
| 620,495 | 2/1899 | Ramseaur, Jr. | 269/153 |
| 893,875 | 7/1908 | Schneider | 269/154 |
| 2,509,056 | 5/1950 | Gartner | 269/57 |
| 2,625,861 | 1/1953 | Swanson | 269/157 |
| 4,445,678 | 5/1984 | George | 269/99 |

*Primary Examiner*—Roscoe V. Parker
*Assistant Examiner*—Judy J. Hartman
*Attorney, Agent, or Firm*—Burns, Doane, Swecker & Mathis

[57] ABSTRACT

A vise for clamping two works comprising a vise body having a groove of T-shaped section and first and second reference surfaces perpendicular to the groove; a pair of movable members fitted in said T-shaped groove between said first and second reference surfaces, having clamping surfaces opposed to said reference surfaces, respectively, and provided at the rear sides opposite to said clamping surfaces with inclined surfaces inclined to converge toward the T-shaped groove; a wedge fitted between said inclined surfaces; a block slidably and disengageably fitted in the T-shaped groove between said movable members; and a bolt connecting said wedge and the block for forcing the wedge toward the block. The second reference surface is disposed on a supporting member which carries an inclined third reference surface. By removing a movable member and reversing the supporting member, the third reference surface opposes the first reference surface for clamping a single work therebetween.

3 Claims, 30 Drawing Figures

FIG. 2
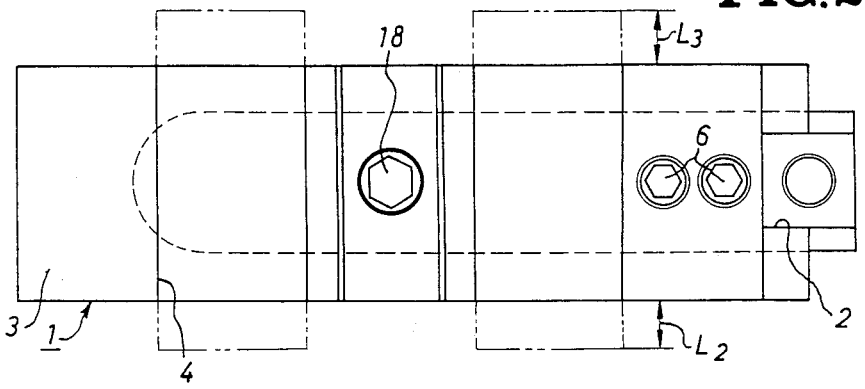
FIG. 1
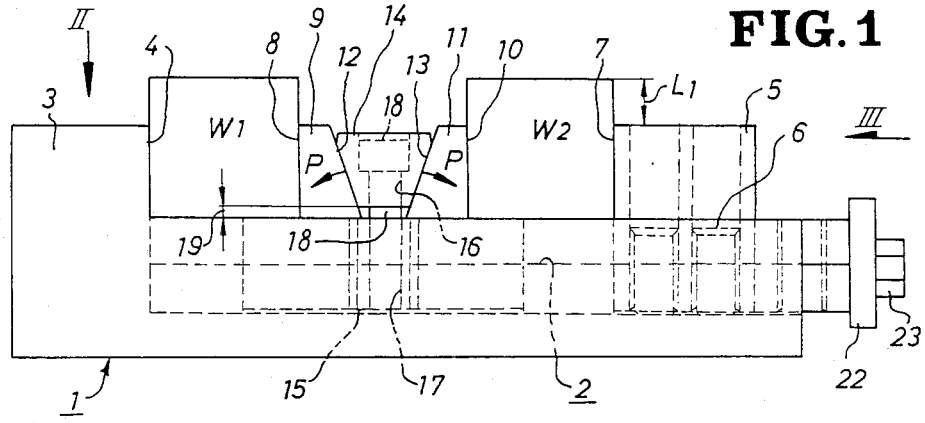
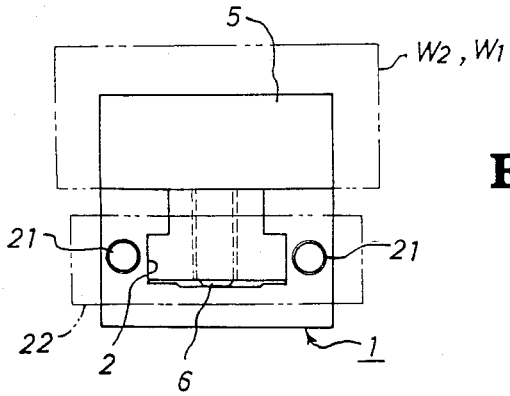
FIG. 3

FIG.6
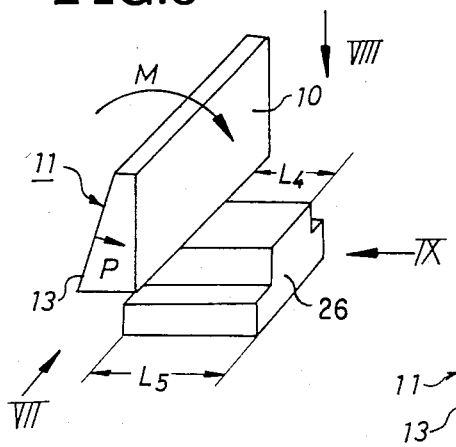
FIG.8
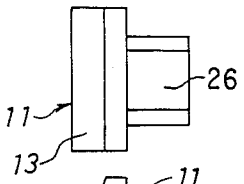
FIG.9
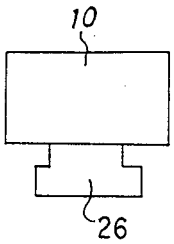
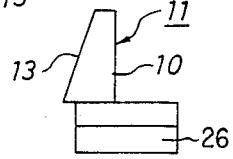
FIG.7
FIG.10
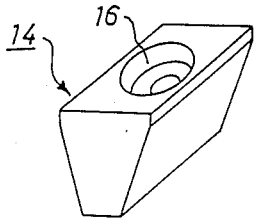
FIG.14
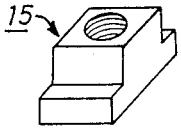
FIG.12
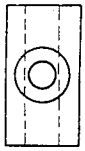
FIG.16
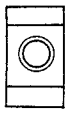
FIG.11
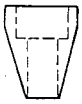
FIG.13
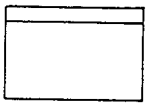
FIG.15
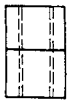
FIG.17
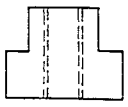

FIG. 18
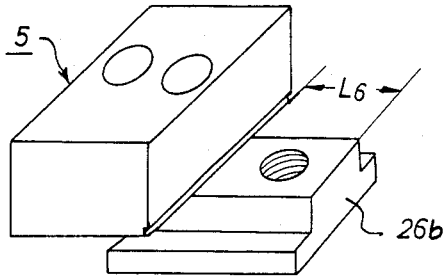
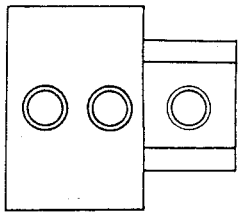
FIG. 20
FIG. 19
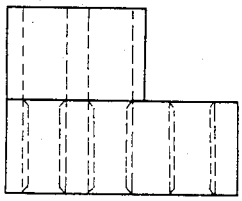
FIG. 21
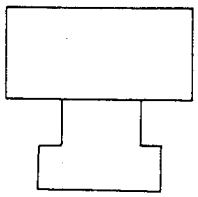

FIG. 22
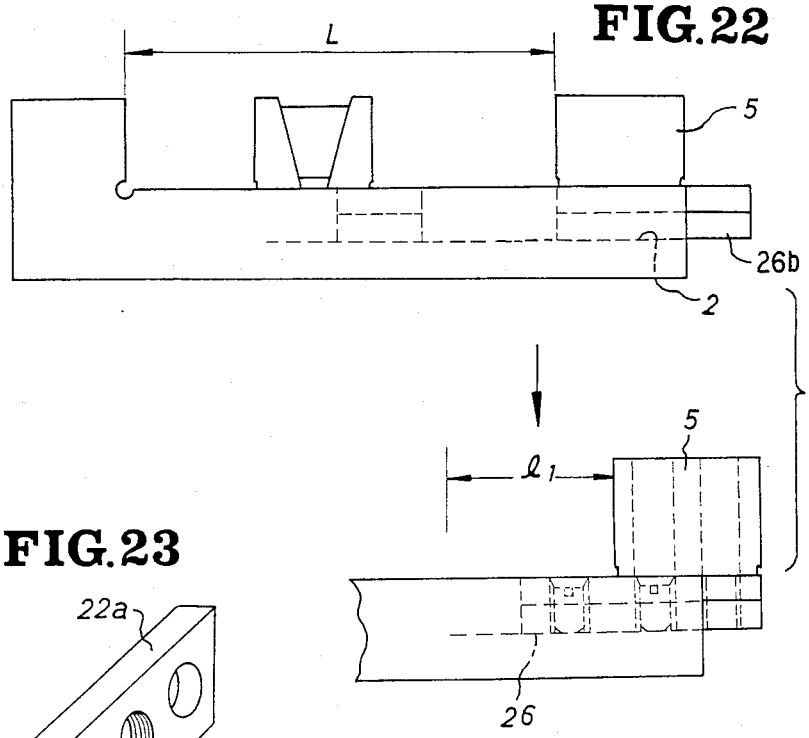
FIG. 23
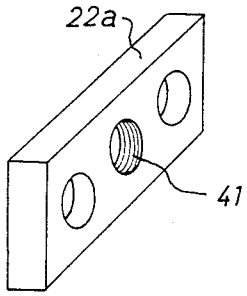
FIG. 24
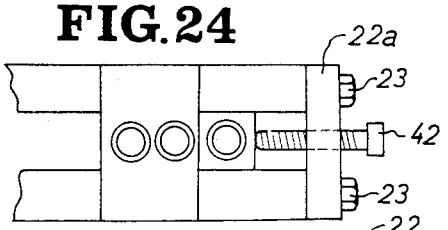
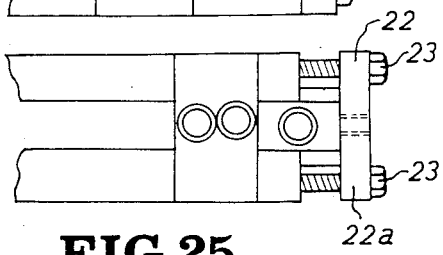
FIG. 25
FIG. 26
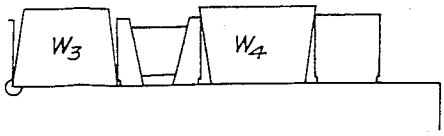

VISE FOR CLAMPING TWO WORKS

BACKGROUND AND SUMMARY OF THE INVENTION

The present invention relates to a vise for clamping two works to be machined, which is equipped in a turntable or a movable table of a machine tool.

Conventionally, in a manufacturing operation of a body of an air-selector valve, one surface of a rectangular parallelpiped material made from aluminum-alloy is milled by a milling cutter to form a reference surface. Then, a port for inserting a valve body is formed parallel to the reference surface by a lathe or the like, and then, a plurality of works, i.e., said bodies, are set on a table by fitting said ports thereof on vertical pins, i.e., jigs, on the table and clamping the works by means of flat bars. However, in this case, the setting position of each work must be changed after each machinging of the surface. Therefore, the operations for changing the positions are labourious, and the clamping forces against the works may become irregular.

Accordingly, it is a primary object of the invention to provide a vise, wherein two works can be securely clamped by one bolt and can be adjusted to securely clamp two works having different thicknesses.

According to the invention, a vise for clamping two woks comprises a vise body having a groove of T-shaped section and first and second reference surfaces perpendicular to the groove; a pair of movable members fitted in said T-shaped groove between said first and second reference surfaces, having clamping surfaces opposed to said reference surfaces, respectively, and provided at the rear sides opposite to said clamping surfaces with inclined surfaces inclined to converge toward the T-shaped groove; a wedge fitted between said inclined surfaces; a block slidably and disengageably fitted in the T-shaped groove between said movable members; and a bolt connecting said wedge and the block for for forcing the wedge toward the block.

Further objects, features and advantages of the invention will appear more fully from the following description of the preferred embodiments of the invention.

BRIEF DESCRIPTION OF THE DRAWINGS

FIG. 1 is an elevation of a vise of an embodiment of the invention;

FIG. 2 is a plan view taken along an arrow II in FIG. 1;

FIG. 3 is a side view taken along an arrow III in FIG. 1;

FIGS. 6–9 are perspective, plan, elevational and side views of a movable member, respectively;

FIGS. 10–13 are perspective, plan, elevational and side views of a wedge, respectively;

FIGS. 14–17 are perspective, plan, elevational and side views of a T-shaped nut, respectively;

FIGS. 18–21 are perspective, plan, elevational and side views of a supporting member, respectively;

FIGS. 22 and 23 are side and perspective views of a stopper, respectively;

FIGS. 24–26 are plan and side views illustrating uses of the embodiment, respectively.

DETAILED DESCRIPTION OF THE PREFERRED EMBODIMENTS

Figure 4:
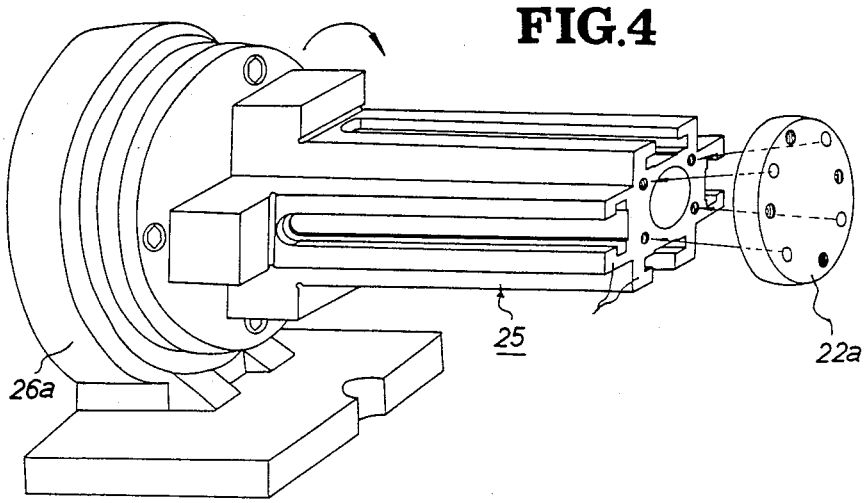
FIG. 4 is a perspective view of a vise of other embodiment.

A vise body 1 is provided at the upper surface with a longitudinally extending groove 2 having a T-shaped section (see FIG. 3). One end of this T-shaped groove 2 is closed by a projection 3 which is integrally provided on the vise body 1. The projection 3 has a first reference surface 4 which is perpendicular to the T-shaped groove 2. A support member 5 is fixed to the other end of the T-shaped groove 2 by two set bolts 6 (FIG. 2). The support member 5 is provided with a second reference surface 7 which is perpendicular to the T-shaped groove 2. Between the first and second reference surfaces 4 and 7, movable members 9 and 11 are slidably and disengageably fitted into the groove 2. The member 9 has a clamping surface 8 opposed to the first reference surface 4. The member 11 has a calmping surface 10 opposed to the second reference surface 7. The members 9 and 11 are provided at the rear sides opposite to the surfaces 8 and 10 with inclined surfaces 12 and 13 which are inclined to converge toward the T-shaped groove 2. Inclined surfaces of a wedge 14 closely contact the inclined surfaces 12 and 13. A T-shaped nut 15 is disposed under the wedge 14 and is slidably fitted in the groove 2. A cap bolt 18 provided with a hexagon hole is inserted through a stepped hole 16 provided in the wedge 14 and is screwed into a screw hole 17 in the T-shaped nut 15. The wedge 14 forced by the tightened bolt 18 forces the movable members 9 and 11 toward the reference surfaces 4 and 7, so that two works W1 and W2 disosed between the projection 3 and the member 9 and between the member 11 and the member 5, respectively, are clamped therebetween and positioned on the vise body 1. Reference 19 indicates a space remained between the wedge 14 and the T-shaped nut 15.

The works W1 and W2 are rectangular parallelpiped blocks made from aluminum-alloy for manufacturing bodies of air-selector valves, and are clamped by the above vise for machining, e.g., by a milling cutter (not shown). After the machining by the milling cutter, the works W1 and W2 are projected through a length L1 upwardly from the vise and are projected through L2 and L3 forwardly and rearwardly from the vise, respectively. If only the upper surface is to be machined, the forwardly and rearwardly projecting lengthes L2 and L3 may be zero. If only the forward and rearward surfaces are to be machined, the upwardly projecting length L1 may be zero. The movable members 9 and 11 have same heights as the projection 3. The height of the wedge 14 is so determined that the wedge 14 may be positioned lower than the clamped works W1 and W2, and preferrably, lower than the movable members 9 and 11, as illustrated. As shown in FIG. 3, a pair of screw holes 21 are formed at respective sides of the T-shaped groove 2 in the body 1. A stopper 22 is fixed to the vise body 1 by bolts 23 screwed into the holes 21. The stopper 22 contacts an end of the support member 5 to fix the the member 5 in the groove 2.

The vise body 1 illustrated in FIGS. 1–3 consists of the elongated single member, which is adapted to be fixed on a work table of the milling cutter (not shown). However, as shown in FIG. 4, four vise bodies 1 may be integrally constructed to form a jig 25. The jig 25 is mounted onto an index table 26*a* which is adapted to turn around a horizontal axis. The table 26a is operated to intermittently turn through 90 degrees at each motion so that three surfaces of each work clamped by the vise may be machined by the milling cutter.

Structures of each parts and members will be described more in details hereinafter.

As shown in FIG. 6, the movable member 11 has an integral slider portion 26, which is designed to be fitted into the T-shaped groove 2 in the vise body 1 and is projected through a length L4 in the longitudinal direction of the T-shaped groove 2 from the clamping surface 10. Therefore, the member 11 has a long length L5. Although, in the clamping condition, the inclined surface 13 receives a load perpendicular thereto, as indicated by an arrow P, from the wedge 14, and thus, a moment M is applied to the member 11, the long slider portion 26 prevents the inclination of the member 11. The shape of the member 11 is also illustrated in FIGS. 7–9. The movable member 9 (FIG. 1) has same sizes and shape as the member 11.

As shown in FIGS. 18–21, the support member 5 has an integral slider portion 26*b*, which is projected through a length L6 from a main body of the member 5, so that the support member 5 may be prevented from inclining when the works are clamped. As shown in FIG. 22, the member 5 can be set at reverse position so that a width L of a space for accommodating the works may be widened. In these ordinary and reverse positions, the supporting member 5 can be fixed at various positions by said stopper 22, as shown in FIGS. 24 and 25. As shown in FIG. 23, a stopper 22*a* provided at the middle portion with a screw hole 41 may be employed. As shown in FIG. 24, a bolt 42 is screw into said screw hole and is projected into the T-shaped groove to support the supporting member. As shown in FIG. 25, this stopper 22*a* can be used similarly to that in FIGS. 1 and 3.

An operation is as follows. In FIG. 1, the supporting member 5 is preset at a position on the vise body 1 determined from sizes of the works W1 and W2. The two works W1 and W2 are set in the positions ilustrated in FIGS. 1–3. Then, the bolt 18 is tightened by a hexagon wrench (not shown). Whereby, the wedge 14 forces the movable members 9 and 11 to move away from each other, and thus, the works W1 and W2 are clamped by the uniform forces. After the machining, the bolt 18 is loosened to release the works.

According to the invention, there is an advantage that the two works w1 and W2 can be securely clamped by the uniform forces only by operating the one bolt 18. Further, the works can be easily released by operating the bolt 18. Since the inclined surfaces 12 and 13 of the movable members 9 and 11 are inclined to converge toward the T-shaped groove 2, the clamping load P of the wedge 14 includes a downward component, which effectively prevents the works W1 and W2 from moving or floating up from the vise body 1, and thus, machining accuracy can be improved. Since the position of the support member 5 can easily be changed by operating the bolts 6, varius works having different thicknesses can easily be mounted, resulting in large applicability.

The present invention may be modified as follows.

Instead of the T-shaped nut 15, the vise may be provided with a T-shaped slider rigidly or integrally including an upwardly extending bolt, which is fitted through the hole 16 and screwed to an upper nut.

Figure 4A:
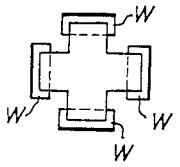
FIGS. 4*a* and 4*b* are schematic side view and perspective view of a work to be machined, respectively.
Figure 4B:
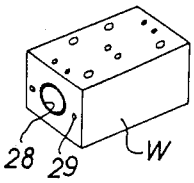
Figure 5:
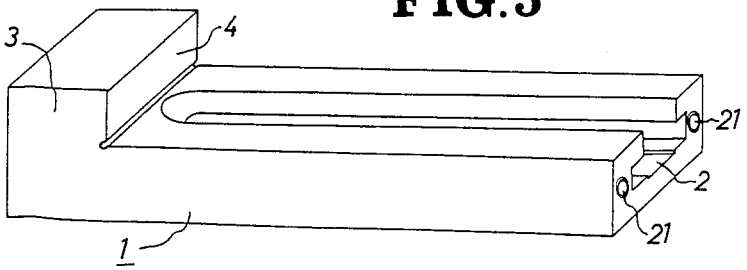
FIG. 5 is a perspective view of a vise body.

As described before, the invention may be modified as shown in FIG. 4. The jig in FIG. 4 is employed in a numerical control machine. In this case, it requires only one setting operation to machine surfaces and portions illustrated by thick solid lines in FIGS. 4*a* and 4*b*, so that work setting time is remarkably reduced and the machining accuracy can be improved. Setting error is also prevented. In FIG. 4*b*, a reference 28 indicates a hole of which inner periphery is machined, and a reference 29 indicates a tapped hole 29. In FIG. 4, 22*a* indicates a circular stopper commonly used for the four support members.

As shown in FIG. 26, works W3 and W4 of trapezoid shapes can securely be clamped. However, the illustrated position of the work W4 is not preferable.

Figure 27:
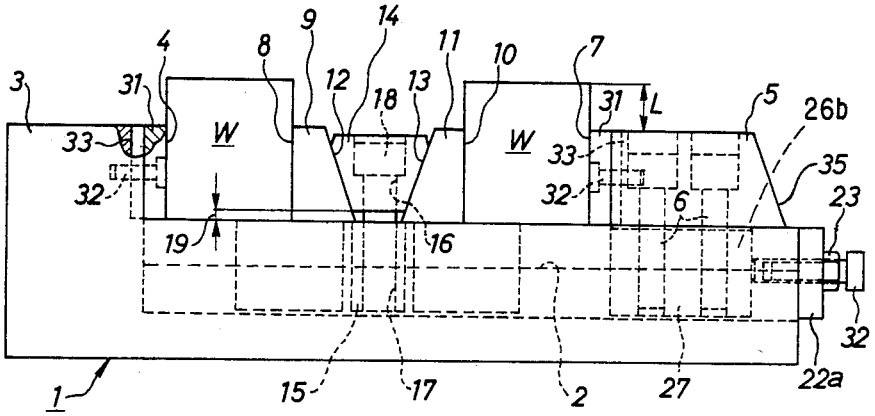
FIGS. 27 and 28 are side views of another embodiment.

Structures in FIG. 27 may be employed.

In FIG. 27, plate-like members 31 are detachably fixed to the surfaces of the projection 3 and the support member 5 near the works by means of bolts 32 and dovetail grooves 33. The reference surfaces 4 and 7 for the works are formed by the surfaces of the members 31.

According to these structures, the members 31 can be changed in accordance with the shape of the works. For example, if columnar works are to be clamped, members 31 having cylindrically concave surfaces (reference surfaces) mating with the outer peripheral surfaces of the works can be used to securely hold the works.

The supporting member 5 and the T-shaped slider portion 26*b* are formed by independent members. The set bolts 6 are used to tighten the member 5 and the portion 26*b* together so that both of them may be rigidly fixed to the vise body 1.

Further, a third reference surface 35 is formed at the rear surface opposite to the second reference surface 7 of the supporting member 5. This reference surface 35 is inclined to move away from the second reference surface 7 in the downward direction.

Figure 28:
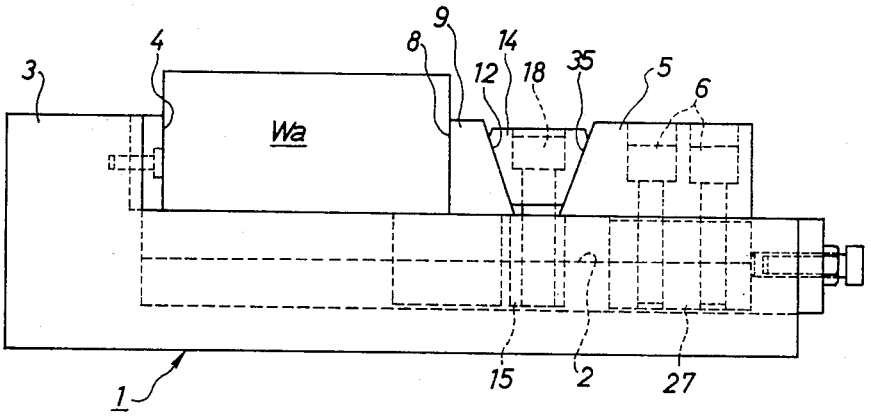

As shown in FIG. 28, the member 5 may be fixed at a reverse position in which the third reference surface 35 is opposed to the first reference surface 4. In this reverse or transformed condition, the movable member 11 (FIG. 27) is removed, and one of the inclined surfaces of the wedge 14 is seated on the third reference surfaces 35. The other inclined surface of the wedge 14 is seated on the inclined surface 12 of the movable member 9. In this condition, a long work Wa can be held between the clamping surface 8 of the movable member 9 and the first reference surface 4. That is; in the case that the supporting member 5 is provided with the third reference surface 35, two works W can be held, as shown in FIG. 27, as well as one long work Wa can be held as shown in FIG. 28, only by changing the position of the supporting member 5.

In the structures in FIGS. 27 and 28, stopper means similar to that in FIG. 24 is employed to fix and position the supporting member.

Although the invention has been described in its preferred form with a certain degree of particularity, it is understood that the present disclosure of the preferred form may be changed in the details of construction and the combination and arrangement of parts may be resorted to without departing from the spirit and scope of the invention as hereinafter claimed.

What is claimed is:

1. A vise which is transformable for selectively clamping one or more works, comprising:

a vise body having a groove of generally T-shaped cross-section extending longitudinally, said groove extending all the way to a first longitudinal end of said body to form a groove open end, a first upstanding reference surface carried by said body adjacent a second longitudinal end of said body opposite said first longitudinal end, said first reference surface oriented perpendicularly relative to a longitudinal axis of said groove, a supporting member slidably mounted in said groove adjacent said groove open end and including second and third upstanding reference surfaces spaced apart longitudinally, said second reference surface oriented parallel to said first reference surface, and said third reference surface being inclined so as to extend at an acute angle toward said groove in diverging relationship to said second reference surface, fastener means for securing said supporting member against sliding movement in said vise body in longitudinally spaced relationship relative to said first reference surface to define a works-receiving space therebetween, first and second movable clamping members relatively slidably mountable in said groove within said worksreceiving space, each of said clamping members including a clamping surface disposed parallel to said first and second reference surfaces, and a wedge surface inclined so as to extend at an acute angle toward said groove in diverging relationship to said clamping surface, said wedge surface acute angle being the same as said third reference surface acute angle, said clamping members being positionable such that said wedge surfaces oppose one another and said clamping surfaces oppose respective ones of said first and second reference surfaces, a wedge positionable between said opposed clamping surfaces and including a pair of inclined surfaces diverging in a direction toward said groove and oriented complementarily to said wedge surfaces, a bolt extending through said wedge and into said vise body for moving said wedge toward said groove to urge said clamping surfaces toward the respective first and second reference surfaces for clamping first and second works therebetween, said fastener means being releasable to permit said supporting member and one of said clamping members to be removed from said groove through said groove open end, said supporting member being re-insertable into said groove after being reversed to position said third reference surface in opposing relationship to the remaining wedge surface to enable said wedge to be positioned therebetween to urge the remaining clamping surface toward said first reference surface for clamping a single work therebetween.

2. A vise according to claim 1, wherein said first and second reference surfaces are removably mounted on said vise body and said supporting member, respectively, so as to be replaceable with reference surfaces of different shape.

3. A vise according to claim 1 including a stop member releasably securable to said vise body for closing said groove open end.

* * * * *